United States Patent [19]

Rahn

[11] Patent Number: 4,705,188

[45] Date of Patent: Nov. 10, 1987

[54] KEG CAP

[75] Inventor: Eckhard F. Rahn, Menomonee Falls, Wis.

[73] Assignee: Miller Brewing Company, Milwaukee, Wis.

[21] Appl. No.: 893,006

[22] Filed: Aug. 1, 1986

[51] Int. Cl.[4] ..... B65D 51/16

[52] U.S. Cl. ..... 220/367; 215/307; 220/203

[58] Field of Search ..... 220/367, 203, 366, 306; 215/310, 307

[56] References Cited

U.S. PATENT DOCUMENTS

| | | | |
|---|---|---|---|
| 3,061,139 | 10/1962 | Edwards | 220/44 |
| 3,173,571 | 3/1965 | Cserny et al. | 220/44 |
| 3,613,938 | 10/1971 | Westcott | 220/44 |
| 3,858,756 | 1/1975 | Fulton | 220/306 |
| 4,049,152 | 9/1977 | Treanor | 220/367 |
| 4,142,658 | 3/1979 | Golding | 222/400.7 |
| 4,234,100 | 11/1980 | Chabot | 220/306 |
| 4,315,578 | 2/1982 | Ludwig, Jr. | 220/366 |
| 4,457,445 | 7/1984 | Hanks et al. | 220/214 |
| 4,496,970 | 1/1985 | Lane, Jr. | 220/306 |

*Primary Examiner*—Stephen Marcus
*Assistant Examiner*—Nova Stucker
*Attorney, Agent, or Firm*—Quarles & Brady

[57] ABSTRACT

A cap for covering the open end of a Barnes neck surrounding the outlet of a keg for malt beverages includes a circular, flat, resilient top; a skirt depending downwardly from the top and having an inwardly directed annular sealing bead for gripping the outside of the Barnes neck and vent means at the junction of the top and skirt. The top, annular bead and vent means cooperate to keep the cap in place when small amounts of fluid are accidentally released from the keg. The cap, in addition, to covering the outlet can bear information as to the keg contents.

3 Claims, 5 Drawing Figures

KEG CAP

FIELD OF INVENTION

The present invention relates to caps for containers. More particularly, it relates to caps for kegs of malt beverages, such as beer.

BACKGROUND OF THE INVENTION

Malt beverages, such as beer, are sold in both small containers, such as bottles and cans, and large containers, such as kegs. The cans and bottles may be disposable, but the kegs are too expensive to discard and must be reused.

Most brewers sell more than one brand of malt beverage, therefore, they prefer to have the kegs marked permanently only with the brewery name and to use other means to identify the specific malt beverage in the container. Such other means may be labels that are attached to the container or caps that are used to cover the outlet of the keg; the caps bear labels or are imprinted with the name of malt beverage and other useful information.

The cap protects the outlet from dust, but it is not intended or needed to prevent the malt beverage from leaving the keg because the outlet which is usually surrounded by a flanged neck, known as a Barnes neck, is closed with a two way valve assembly of the type shown in the Golding U.S. Pat. No. 4,142,658.

The two way valve assembly which is normally maintained in a closed condition by springs can accidently open to release small amounts of liquid or gas when the container is severely jarred, such as can occur when it is dropped three feet or more on to a hard unyielding surface. When that occurs the escaping liquid or gas can blow the conventional cap off the Barnes neck and the identifying information is lost.

There is a need for a simple inexpensive cap that will both remain on the keg when the valve assembly accidentally opens and not interfere with the operation of the valve assembly.

BRIEF SUMMARY OF THE INVENTION

The object of the present invention is to disclose an inexpensive cap for covering the outlet of a keg of malt beverage.

It is a further object to disclose a cap which will remain in place when the valve assembly in the outlet accidentally opens and which will not interfere with the normal operation of the valve assembly.

DETAILED DESCRIPTION OF THE INVENTION

Figure 1:
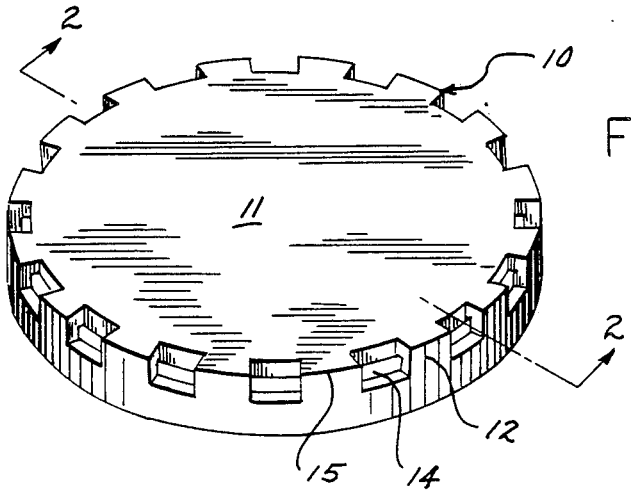
FIG. 1 is a perspective view of the cap of the present invention.
Figure 2:
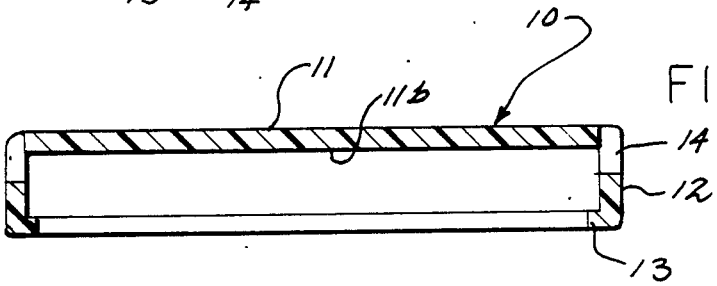
FIG. 2 is a view, partly in section, taken along line 2—2 of FIG. 1.

In FIGS. 1 to 4 of the drawings, it can be seen that the cap 10 has a flat, resilient, circular top 11, and a depending skirt 12 with an inward directed annular sealing bead 13.

As best seen in FIGS. 2 to 5, vent means comprising a plurality of openings 14 are located at the junction 15 of the top 11 and skirt 12.

Figure 3:
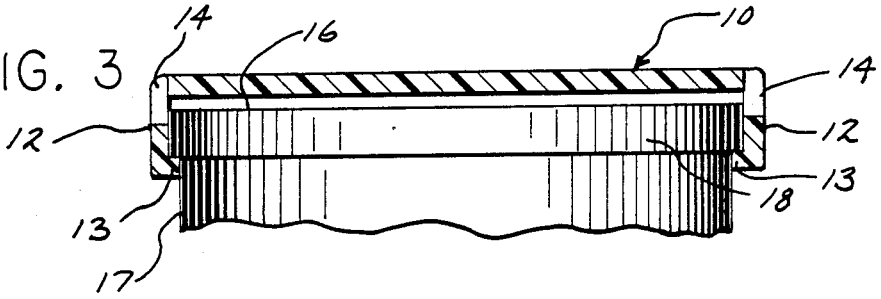
FIG. 3 is a view, partly in section, showing the position of the cap of FIG. 1 on the Barnes neck of a keg when the valve assembly is closed.

Turning to FIG. 3, it can be seen that when the cap 10 is positioned upon the open end 16 of a Barnes neck 17, surrounding the outlet of a keg, the annular bead 13 grips the outside of the Barnes neck 17 and keeps the underside **11*b* of the top 11 slightly above the mouth of the open end 16. This is the normal position of the cap 10** when the valve assembly (not shown) in the outlet is closed.

Figure 4:
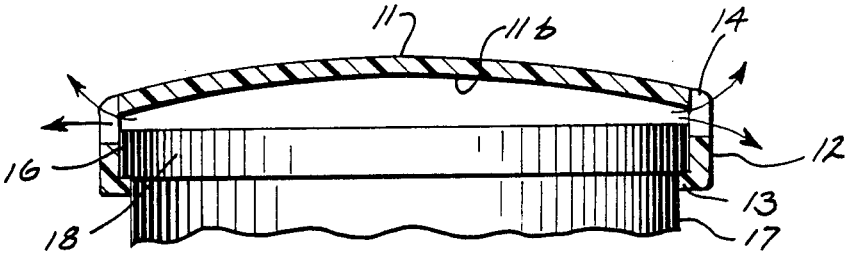
FIG. 4 is a view, partly in section, showing the position of the cap of FIG. 1 on the Barnes neck of a keg when the valve assembly is accidentally opened.
Figure 5:
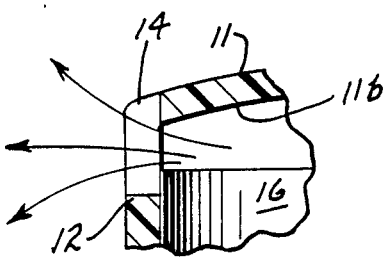
FIG. 5 is an enlarged partial view showing the flow of fluid through a vent opening of the cap in FIG. 4.

In FIGS. 4 and 5, the position of the cap 10 is seen when the valve assembly of the keg is accidentally open. In this position, fluid, comprising gas and liquid, can leave the keg via the open end 16 of the Barnes neck 17 and escape from under the cap 10 via the openings 14. When the fluid is escaping, the fluid pressure on the underside **11*b* of the resilient top 11 causes it to flex outwardly from the position seen in FIG. 3 which helps to absorb and to dissipate the pressure caused by the released fluids and to keep the cap 10** in place.

The annular bead 13 on the cap 10 also cooperates with an outwardly extendingly flange or rim 18 which extends about the periphery of the open end 16 of the Barnes neck 17 to help keep the cap 10 in place when fluid is escaping. As the resilient top 11 is flexed outwardly by the escaping fluid, the grip of the annular sealing bead 13 on the sidewall of the Barnes neck 17 is increased further helping to prevent the cap 10 from being blown off.

The preferred cap 10 is molded of a suitable thermoplastic material, such as high density polyethylene, and it has a circular top 11 which is sufficiently resilient to flex as shown in the drawings to help absorb the pressure of the escaping fluid. The openings 14 are either formed in the cap 10 during molding or are formed by cutting away portions of the molded cap 10. The openings 14 are located at the junction 15 of the top 11 of the cap 10 and the skirt 12 so that when the relief valve is open the released fluid can escape along the paths of least resistance as shown by the arrows in FIGS. 4 and 5.

The vent means can take other forms than the openings 14 provided it functions in cooperation with top 11 and the annular bead 13 to prevent the released fluids from exerting sufficient force on the cap 10 to blow it off its position on the Barnes neck 17. Such equivalent forms of the vent means are intended to be covered by the claims.

The top 11 of the cap, in addition to being resilient, preferably has an outer surface which is receptive to receiving the identifying and other information desired to be borne by the cap. The information is preferably printed directly upon the outer surface of the top, but it can be imprinted on a label affixed to the top, if desired. If such a label is used it should not, of course, be so large as to interfere with the operation of the vent means.

It will be readily apparent to those skilled in the art that a number of other changes and modifications may be made without departing from the spirit and scope of the present invention. For example, in place of the continuous annular sealing bead which is illustrated, an annular sealing bead that is interrupted by one or more spaces may be used provided it functions in a suitable manner. In addition, the downwardly depending skirt may also be interrupted by openings other than the vent means; provided, it does not detract from the operation of the cap. Therefore, it is intended that the invention not be limited except by the claims.

I claim:

1. In an identification cap for covering and protecting the open end of a Barnes neck of a malt beverage keg, which cap includes a circular central portion having a flat bottom surface for covering the open neck and a flat top surface for bearing identifying information; and, a skirt which depends downwardly from the periphery of said central portion and grips the outside of the Barnes neck, the improvement which comprises a plurality of vent openings extending through both the skirt and the central portion at the junction of said central portion and said skirt so that fluids accumulating under said cap can escape to the outside by flowing both horizontally and vertically through said vent openings without blowing said cap off the Barnes neck.

2. In an identification cap of claim 1, the further improvement which comprises said central portion being resilient so that it will flex outwardly when there is a fluid pressure exerted on its flat bottom surface.

3. In an identification cap of claim 2, the further improvement which comprises an annular seal about the interior periphery of the skirt, which seal grips the outside of the Barnes neck more securely when the resilient central portion flexes outwardly.

* * * * *